US005320594A

United States Patent [19]

Huang

[11] Patent Number: 5,320,594

[45] Date of Patent: Jun. 14, 1994

[54] MULTIPURPOSE GYMNASTIC APPARATUS

[76] Inventor: Ming-Chih Huang, 11F, No. 46, Sec. 2, Chung Shan N. Road, Taipei, Taiwan

[21] Appl. No.: 125,694

[22] Filed: Sep. 24, 1993

[51] Int. Cl.[5] ..... A63B 21/00

[52] U.S. Cl. ..... 482/147; 482/71

[58] Field of Search ..... 482/146, 147, 148, 70, 482/71, 79, 51, 23, 72-73; 434/253

[56] References Cited

U.S. PATENT DOCUMENTS

| | | | |
|---|---|---|---|
| 4,930,771 | 6/1990 | Wilson | 482/147 |
| 4,961,574 | 10/1990 | Lew | 482/147 |
| 4,976,425 | 12/1990 | Barnes | 482/147 |

*Primary Examiner*—Stephen R. Crow

*Attorney, Agent, or Firm*—Jacobson, Price, Holman & Stern

[57] ABSTRACT

A gymnastic apparatus comprised of a rectangular base having a recessed seat, a rotating table fastened to the recessed seat for twisting the body and alternatively retained between a fixed position and a rotating position, an ergonomically engineered head rest fastened to the base at one end and adjusted to the desired angular position, collapsible stands fastened to the base at the four corners thereof by stand holders and alternatively locked between the operative vertical position and the non-operative horizontal position, and two ski poles fastened to two cross tubes at one end of the base by clamping devices and locknut devices and fixed in position according to the desired pitch between the ski poles.

2 Claims, 3 Drawing Sheets

MULTIPURPOSE GYMNASTIC APPARATUS

BACKGROUND OF THE INVENTION

The present invention relates to a multipurpose gymnastic apparatus which comprises a base, a rotating table mounted within a recessed seat on the base for twisting the body can be fixed as desired, an ergonomically engineered head rest adjusted to the desired angular position at one end of the base, collapsible stands to support the base stably on the ground, ski poles bilaterally disposed on the base at the top for the holding of the hands.

A variety of gymnastic apparatus have been disclosed, and have appeared on the market. These apparatus are commonly designed for a specific purpose. Therefore, one may have to prepare various gymnastic apparatus for different exercises. It is expensive and requires much installation space when several gymnastic apparatus are prepared. Further, the ski poles of conventional gymnastic apparatus cannot be adjusted to change the pitch therebetween once installed. There are universal gymnastic apparatus which provide a variety of functions for exercising different parts of the body. However, these universal gymnastic apparatus are commonly heavy and very expensive.

SUMMARY OF THE INVENTION

The present invention provides a multipurpose gymnastic apparatus which eliminates the aforesaid problems and drawbacks. According to one aspect of the present invention, the multipurpose gymnastic apparatus comprises a rotating table fastened in a recessed seat on the base thereof. The rotating table can be retained in a rotating position for twisting the body. When not desired, the rotating table can be fixed in position and prohibited from being rotated. According to another aspect of the present invention, a head rest is fastened to the base at one end for resting the head as the user lies on the base. The angular position of the head rest can be adjusted simply by loosening a fastening screw and then fastening it up again. According to still another aspect of the present invention, the stands of the multipurpose gymnastic apparatus can be fixed between an operative position and a collapsed position, and therefore the elevation of the base of the gymnastic apparatus is relatively adjusted. According to still another aspect of the present invention, two ski poles are bilaterally fastened to the base at one end. The ski poles are respectively made in a curved configuration, and therefore the pitch between the ski poles can be adjusted by turning the ski poles on the base before they are locked.

DETAILED DESCRIPTION OF THE PREFERRED EMBODIMENT

Figure 1:
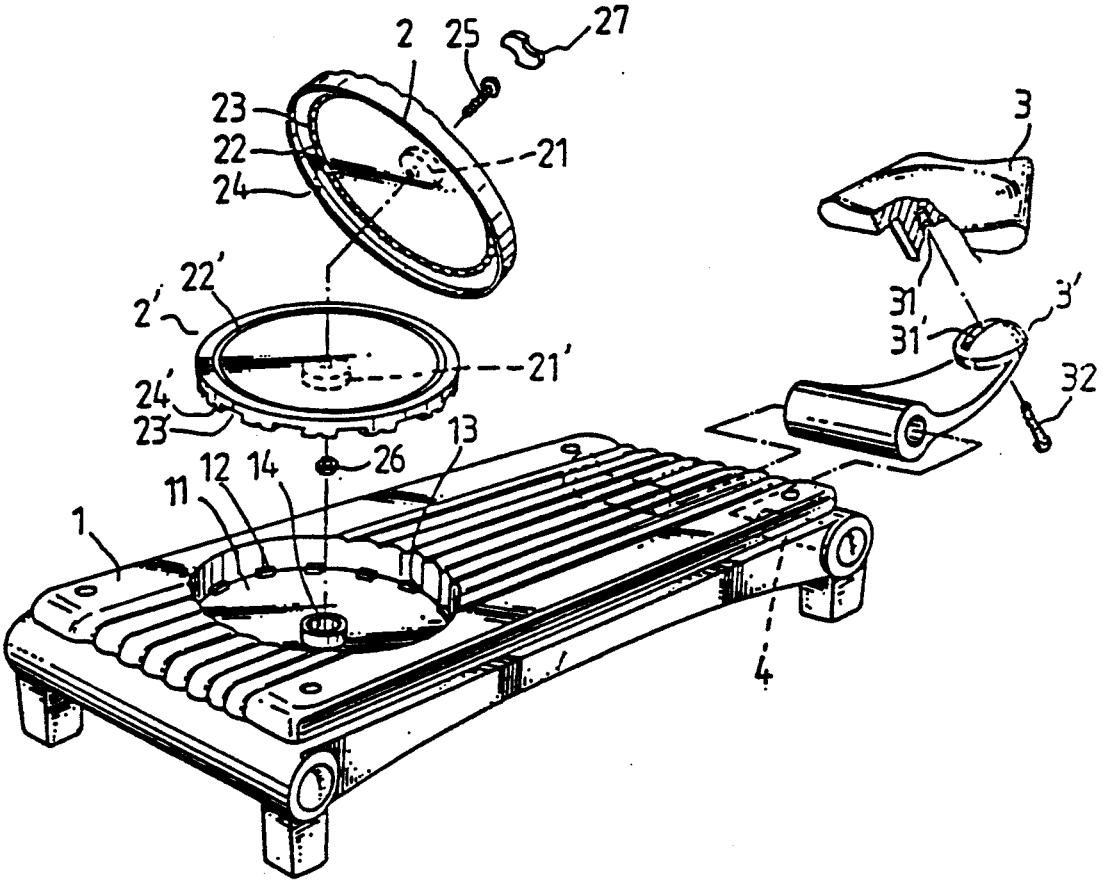
FIG. 1 is an exploded view of the upper part of a multipurpose gymnastic apparatus according to the preferred embodiment of the present invention.
Figure 2:
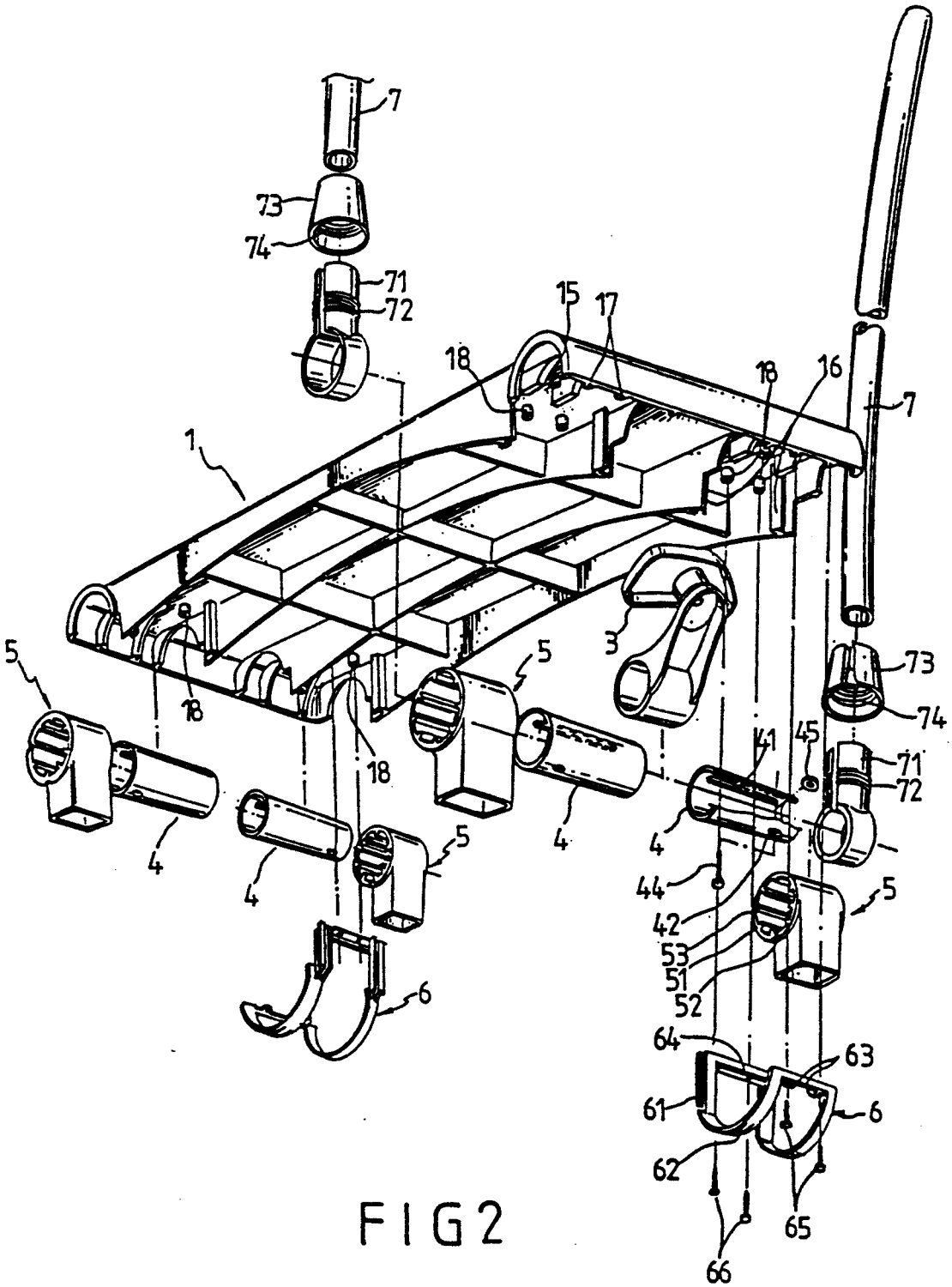
FIG. 2 is an exploded view of the lower part of the multipurpose gymnastic apparatus of FIG. 1.
Figure 3:
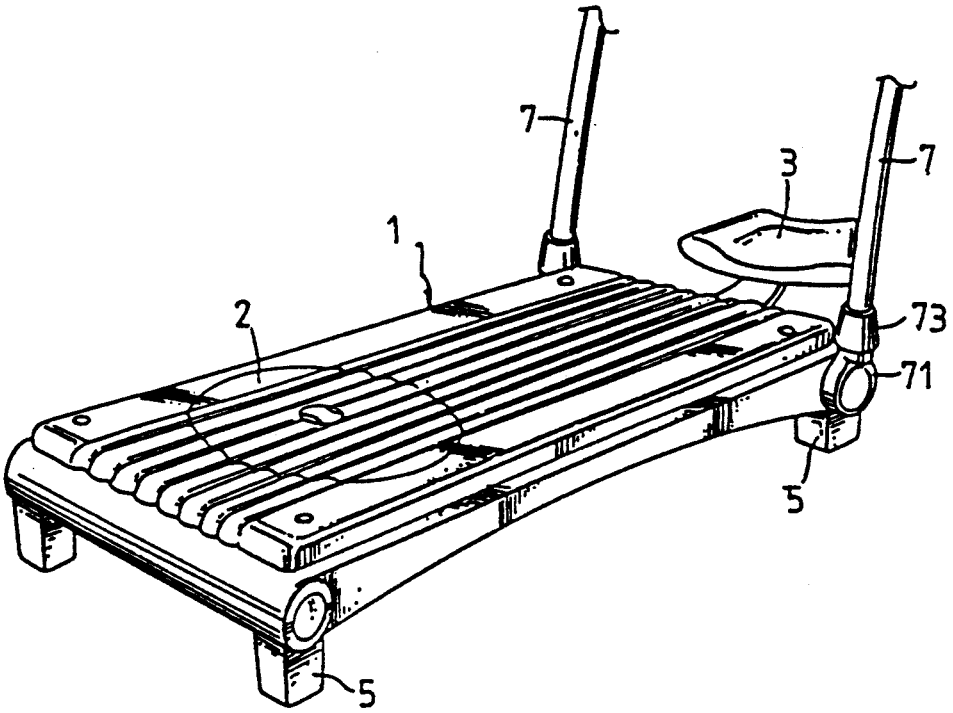
FIG. 3 is an elevational view of the multipurpose gymnastic apparatus of FIG. 1.

Referring to FIGS. 1 and 2, a multipurpose gymnastic apparatus in accordance with the present invention is generally comprised of a base 1, a rotating table, which is comprised of a bottom disk 2' and a cover disk 2 covered on the bottom disk 2', a head rest 3, cross tubes 4, stands 5, stand holders 6, and ski poles 7.

The base 1 of the gymnastic apparatus is made in a rectangular configuration comprising a recessed seat 11, which receives the rotating table 2, a plurality of teeth 12 spaced around the border inside the recessed seat 11, locating pins 13 respectively projected from the teeth 12 to retain the rotating table 2 in the recessed seat 11, and a stub tub 14 raised in the center of the recessed seat 11.

The cover disk 2 comprises a center hole 21, a plurality of retaining notches 24 on the bottom around the border, a bottom annular groove 22 on the bottom surrounded by the retaining notches 24, and a plurality of rolling balls 23 inserted into the bottom annular groove 22. The bottom disk 2' comprises a center hole 21', a top annular groove 22' on the top aligned with the bottom annular groove 22 to carry the rolling balls 23, a plurality of openings 23' and retaining notches 24' at the bottom spaced around the border. A male fastening element 25 is inserted through the center hole 21 on the cover disk 2 and the center hole 21' on the bottom disk 2', and then fastened up with a female fastening element 26 to hold the cover disk 2 and the bottom disk 2' together. A handle 27 is fastened to the center through hole 21 of the cover disk 2. When assembled, the rotating table can be conveniently fastened to the recessed seat 11 of the base 1 by inserting the bottom disk 2' into the recessed seat 11 for letting the teeth 12 insert into the openings 23' and then turning the cover disk 2 for permitting the locating pins 13 to be respectively engaged into the retaining notches 21, and therefore the cover disk 2 is locked in position. On the contrary, the cover disk 2 can be turned on the bottom disk 2' by lifting the handle 27 to disengage the openings 23' from the teeth 12 and then turning the cover disk 2 for permitting the locating pins 13 to be respectively engaged into the retaining notches 21' on the bottom disk 1'. Therefore, the user can stand on the cover disk 2 and twist the body.

The head rest 3 is fastened to the base 1 by a head rest holder 3'. The head rest 3 comprises a screw hole 31 on the concave bottom thereof. The head rest holder 3' has one end formed into a tube mounted around two cross tube 4 retained at one end of the base 1, and an opposite end formed into a circularly raised portion fitted into the concave bottom of the head rest 3. The raised portion of the head rest holder 3' has an elongated slot 31' through which a screw 32 is threaded into the screw hole 31 on the head rest 3 to secure the head rest 3 to the head rest holder 3'. By loosening the screw 32, the position of the head rest 3 can be adjusted on the head rest holder 31' within the range of the elongated slot 31'. When not in use, the head rest holder 3' and the head rest 3 can be turned downward and received below the base 1.

There are total two pairs of cross tubes 1 respectively fastened to the base 1 at two opposite ends along the width of the base 1. The combined length of each pair of cross tubes is equal to the width of the base 1. Either pair of cross tubes 4 are longitudinally aligned. Each cross tube 4 comprises a longitudinal slot 41, and a mounting hole 42 opposite to the longitudinal slot 41. The cross tubes 4 are respectively fastened to the base 1 by fastening elements 44 and packing rings 45. By inserting a respective fastening element 44 through the mounting hole 42 and the longitudinal slot 41 and a respective packing ring 45 and then into a respective fastening hole 15 on the base 1, the cross tubes 4 are respectively fastened to the base 1. The packing ring 45 has a curved outer surface fitted over the outer wall of the cross tubes 4. The design of the longitudinal slot 41 allows each cross tube 4 to be moved axially.

The stands 5 are respectively fastened to the base 1 and mounted on the cross tubes 4. Each stand 5 has a top end formed into a tubular section comprising a series of teeth 51 around the inside wall, first locating notches 52 and second locating notches 53 on two opposite ends of the tubular section. The inner diameter defined within the teeth 51 is approximately equal to the outer diameter of the cross tubes 4, and therefore the stands 5 can be respectively mounted around the cross tubes 1.

The stand holders 6 are respectively made in the shape of an arched open frame. Each stand holder 6 comprises two substantially L-shaped retaining rods 61 spaced on one side, inward projecting spring leaves 62 spaced at the bottom, and mounting holes 63;64 at two opposite sides. During the installation, the stand holder 6 is mounted around the respective stand 5 for permitting the L-shaped retaining rods 61 to be respectively engaged into respective L-shaped retaining grooves 16 on the base 1, and then fastening elements 65;66 are respectively inserted through the mounting holes 63;64 into respective fastening holes 17;18 on the base 1. When installed, the stands 5 can be respectively turned downwards to a vertical position for supporting the base 1 on a flat surface. As the stands 5 are respectively turned to the vertical position, the spring leaves 62 on the stand holders 6 are respectively engaged into the respective first locating notches 52 on the stands 5 to lock the stands 5 in the operative position. On the contrary, as the stands 5 are turned upwards from the vertical position to a horizontal position closely attached to the bottom of the base 1, the spring leaves 62 on the stand holders 6 are respectively engaged into the respective second locating notches 53 to lock the stands in the collapsed position.

The ski poles 7 are respectively fastened to the two cross tubes 4 at one end of the base 1 by a respective clamping device 71 and a respective locknut device 73. The clamping device 71 has one end formed into a horizontal tube mounted around the respective cross tube 4, and an opposite end formed into a vertical split tube perpendicularly extended upward from the horizontal tube to hold one end of the respective ski pole 7. An outer thread 72 is made around the vertical split tube of the clamping device 71. The locknut device 73 is made gradually smaller toward the top, having an inner thread 74 threaded onto the outer thread 72 of the clamping device 71 to tighten up the connection between the clamping device 71 and the respective ski pole 7. The ski poles 7 are respectively made in a smoothly curved configuration. By loosening the locknut device 73, the ski poles 7 can be turned on its own axis in the respective clamping device 71, and therefore the pitch between the two ski poles 7 can be adjusted according to the user's preference.

What is claimed is:

1. A multipurpose gymnastic apparatus comprising:

a base made in a rectangular configuration, said base comprising a recessed seat, a plurality of teeth spaced around the border inside said recessed seat, locating pins respectively projected from said teeth, a stub tub raised from said recessed seat in the center, fastening holes and L-shaped retaining grooves spaced at the bottom;

a rotating table mounted on said recessed seat, said rotating table comprised of a cover disk and a bottom disk, said cover disk comprising a center hole, a plurality of retaining notches spaced around the border at the bottom, a bottom annular groove surrounded by the retaining notches of said cover disk, and a plurality of rolling balls received in said bottom annular groove, said bottom disk comprising a center hole connected to the center hole on said cover disk by fastening elements, a top annular groove on aligned with said bottom annular groove to carry said rolling balls, a plurality of openings and retaining notches spaced around the border at the bottom;

two pairs of cross tubes respectively fastened to said base, the combined length of each pair of cross tubes being equal to the width of said base, each pair of cross tubes being longitudinally aligned and fastened to said base at either end along the width of said base, each cross tube comprising a longitudinal slot and a mounting hole at two opposite locations fastened to respective fastening holes on said base by fastening elements and packing rings, said packing rings having a respective curved outer surface fitted over the respective cross tube, said longitudinal slot allowing the respective cross tube to be moved axially on said base;

a head rest fastened to said base at one end by a head rest holder, said head rest comprising a mounting hole on a concave bottom thereof, said head rest holder comprising a tube at one end mounted around either pair of cross tubes, a raised portion on an opposite end fitted over the concave bottom of said head rest, and an elongated slot connected to the mounting hole on said head rest by a fastening element;

four stands respectively fastened to said base at four corners, each stand having a top end terminated to a tubular section mounted around either cross tube, said tubular section comprising a series of teeth engaging around the respective cross tube, first locating notches and second locating notches on two opposite ends thereof;

stand holders respectively made in the shape of an arched open frame, each stand holder comprising two L-shaped retaining rods engaged into respective L-shaped retaining grooves on said base, inward projecting spring leaves spaced at the bottom alternatively engaged into said first locating notches and second locating notches to hold said stands between a collapsed position and an operative position, and mounting holes fastened to respective fastening holes on said base by fastening elements; and two curved ski poles respectively fastened to said base at either end by a respective clamping device and a respective locknut device, said clamping device having one end formed into a horizontal tube mounted around either cross tube, and an opposite end formed into a vertical split tube perpendicularly extended upward from the horizontal tube to hold one end of the respective ski pole, said vertical split tube of said clamping device having an outer thread, said locknut device being made gradually smaller toward the top, having an inner thread threaded onto the outer thread on said clamping device to tighten up the connection between the respective clamping device and the respective ski pole;

whereby the teeth on said recessed seat of said base are respectively inserted into the openings on said bottom disk of said rotating table and the locating pins on the teeth of said recessed seat are respectively engaged into the retaining notches on said cover disk, so that said rotating table is locked in said recessed seat and prohibited from rotary motion; said cover disk can be rotated on said bottom disk within said recessed seat by disengaging the locating pins of the teeth of said recessed seat from the retaining notches on said cover disk and then engaging them into the retaining notches on said bottom disk.

2. The multipurpose gymnastic apparatus of claim 1 wherein said fastening elements include screws and rivets.

* * * * *